United States Patent [19]

Peterson

[11] 4,245,394

[45] Jan. 20, 1981

[54] CLAMPING DEVICE FOR STRAIGHT EDGE

[76] Inventor: Jerald G. Peterson, 4115 SE. 30th Ave., Edmond, Okla. 73034

[21] Appl. No.: 8,772

[22] Filed: Feb. 2, 1979

[51] Int. Cl.[2] ..... B43L 13/02

[52] U.S. Cl. ..... 33/430

[58] Field of Search ..... 33/430, 443, 469, 470, 33/468; 269/236, 231, 217, 138

[56] References Cited

U.S. PATENT DOCUMENTS

| | | | |
|---|---|---|---|
| 3,806,107 | 4/1974 | Pitzer et al. | 269/236 X |
| 4,095,345 | 6/1978 | Smith | 33/443 |

FOREIGN PATENT DOCUMENTS

| | | | |
|---|---|---|---|
| 231615 | 4/1925 | United Kingdom | 33/443 |

*Primary Examiner*—Harry N. Haroian

*Attorney, Agent, or Firm*—Witherspoon & Hargest

[57] ABSTRACT

A clamping device for clamping a straight edge to a board to hold such straight edge in place during use thereof. Two clamping members are moveably interconnected to opposite ends of a shaft which extends through an aperture in a bearing member. The bearing member is connected to the straight edge, and the shaft moveably extends through such aperture. The clamping members are provided with locking means, and when such means are operatively locked one clamping member engages and exerts a compressive force against one surface of a board and the other clamping member engages the bearing member to thereby exert an opposing compressive force to lock the straight edge in place.

9 Claims, 4 Drawing Figures

CLAMPING DEVICE FOR STRAIGHT EDGE

BACKGROUND OF THE INVENTION

The invention is directed to clamping devices for use in holding a straight edge in a predetermined position while using such straight edge as a guide for drawing a straight line, cutting glass, sawing, cutting mats for pictures, and any other uses for which a straight edge is required. In using a straight edge, there are a number of features which would be desirable if attainable. For example, of primary importance in assuring that the job does not have to be repeated due to slippage of the straight edge, it is desirable to provide means to maintain the straight edge in place during operation. Preferably, such means will be easy to use and allow proper alignment of the straight edge in as expedient a manner as possible. Heretofore, it was common practice to use a hand and the weight of the body to hold a straight edge in place. However, such a practice does not assure that the straight edge will stay in position during use. In addition, such use of the straight edge involves a strain upon the individual to the extent that it is necessary to exert a positive force upon the straight edge while drawing a line, cutting, etc. In those instances involving larger workpieces in particular, there is also the problem of the awkward positioning of the body and the discomfort resulting therefrom.

Efforts have been made to overcome such problems. For example, it has been suggested that a nail be positioned at both ends of the straight edge to hold it in place. This is obviously a time consuming process and requires putting holes into the board or other surface upon which the workpiece is positioned.

Others have suggested the use of a hand clamp similar in construction to spring biased pliers. Or, alternatively, to a C-clamp. Such devices have limited application in that if pressure is exerted against the straight edge during the drawing or cutting operation, the straight edge will have a tendency to swing out of alignment.

Prior attempts to design a holder have included the use of a device having a pressure-applying member of elliptical cross section which is rotatable relative to a frame and which, when pivoted within such frame, frictionally grips the board and straight edge between such member and a guide. Such device provides limited contact between the pressure-applying member and the straight edge to the extent that such contact is solely along a line defining the high point of the elliptical surface. Accordingly, it can be expected that the degree of pressure distribution is limited and that pressure exerted against the straight edge may cause it to move. In addition, in such a device, the elliptical surface directly engages and, therefore, may undesirably deface the surface of the straight edge, particularly when such straight edge is a wooden or plastic T-square. A prior art device of this type also includes an L-shaped guide which is moved vertically to meet the bottom of the drawing or cutting board, and for this purpose is provided with two screws which must be tightened to hold the guide in place. Such screws ride in slots, and to assure proper contact with the cutting or drawing board requires that the screws be moved to a uniform degree along the slots. Otherwise an imbalance may occur having an adverse affect upon the maintaining of the straight edge in place. In addition, in such a device the structural relationship between the straight edge and its associated holder has restricted the orientation of the straight edge such that it is substantially perpendicular to the edge of the drawing or cutting board and cannot be angularly oriented if desired.

Many other prior art devices exist but such devices appear to include either complex mechanisms or clamping structure not adequate to maintain the straight edge in position in those instances requiring pressure upon the straight edge.

Accordingly, it is an object of this invention to provide a clamping device which maintains a straight edge in place while pressure is being exerted thereupon.

Another object of this invention is to provide a clamping device which may be locked in position with minimum effort.

Still another object of this invention is to provide a clamping device which allows for proper alignment of a straight edge in an expedient manner.

A further object of this invention is to provide a clamping device the use of which involves a minimum amount of strain upon, and awkward positioning of, the body of the user of such device.

Still a further object of this invention is to provide a clamping device the use of which allows for maintaining a straight edge in place without defacing the underlying board or straight edge.

Yet another object of this invention is to provide a clamping device which prevents a straight edge from swinging out of alignment when pressure is exerted thereupon.

Another object of this invention is to provide a clamping device which adequately distributes the pressure upon a straight edge to hold it in place.

Still another object of this invention is to provide a clamping device having means to accurately adjust such device for use with boards of various thicknesses.

Yet another object of this invention is to provide a clamping device which does not comprise a complex mechanism.

Another object of this invention is to provide a clamping device which allows for orienting the straight edge at any desired angle relative to the edge of the board.

SUMMARY OF THE INVENTION

This invention achieves these and other objects by providing a clamping device for clamping a straight edge to a board comprising a bearing member which includes an aperture therethrough. Means are coupled with such bearing member for connecting it to the straight edge. An elongated shaft moveably extends through such aperture and has a first clamping member moveably interconnected to one end thereof and a second clamping member moveably interconnected to the other end thereof. Means are coupled with the clamping members for operatively locking them in place upon such shaft. The clamping members are moveable relative to each other and the shaft such that when the clamping members are operatively locked in place, the first clamping member engages and exerts a compressive force against one surface of the board and the second clamping member engages the bearing member and thereby also exerts a compressive force against the opposing surface of the board to lock the straight edge in place.

DESCRIPTION OF THE DRAWINGS

This invention may be clearly understood by reference to the attached drawings in which.

DESCRIPTION OF PREFERRED EMBODIMENT

Figure 1:
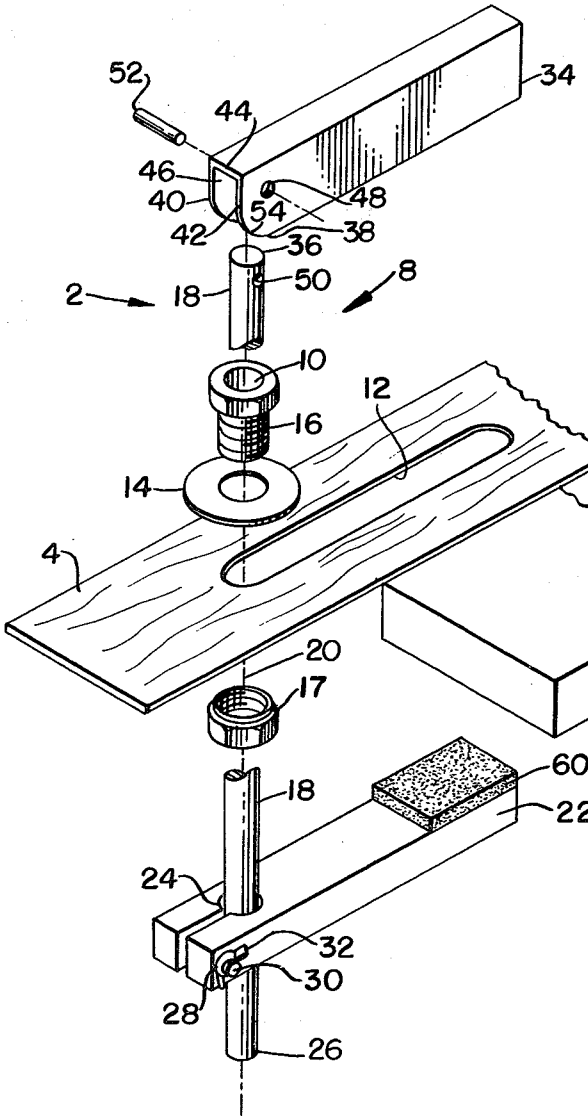
FIG. 1 is an exploded view of the clamping device of the present invention.

The embodiment of this invention, which is depicted in the drawings, is one which is particularly suited for achieving the objects of this invention. The drawing depicts the clamping device 2 of this invention, and for purposes of illustration is shown for use with straight edge 4 and board 6. Clamping device 2 comprises a bearing member 8 including an aperture 10 therethrough. Means are coupled with bearing member 8 for connecting it to the straight edge 4. For example, in the drawings clamping device 2 is shown for use with straight edge 4 having an aperture 12 therethrough. Although not limited to such a structure, in the preferred embodiment aperture 12 is an elongated slot to permit clamping device 2 to be slid along the straight edge to the desired position before the straight edge is locked in place as described herein. Bearing member 8 comprises a washer or radially extending flange 14 coupled to one end of a cylindrical sleeve 16. The bearing member 8 is connected to the straight edge 4 by inserting the sleeve 16 through the aperture 12. In the preferred embodiment, the end of sleeve 16 extending through aperture 10 is threaded, and the bearing member 8 further comprises a nut 17 which is threaded upon the sleeve to sandwich the straight edge 4 between the flange 14 and nut 17.

An elongated shaft 18 extends through aperture 10 and is moveable with respect thereto in a direction parallel to the longitudinal axis 20 of such shaft.

A first clamping member 22 is moveably interconnected to one end of shaft 18 such that clamping member 22 may be moved relative to the shaft 18, clamping member 22 also including means coupled therewith for operatively locking the clamping member 22 in place upon the shaft. For example, in the preferred embodiment, the first clamping member includes an opening 24 through which one end 26 of shaft 18 extends, and an aperture 28, the longitudinal axis of which extends transverse to the longitudinal axis of the aperture 24. A bolt 30 extends through aperture 28 and has a nut 32 threaded thereupon. In this embodiment the first clamping member may be slid upon shaft 18 to the desired position. Then, by tightening nut 32, the first clamping member may be operatively locked in place upon the shaft.

Figure 4:
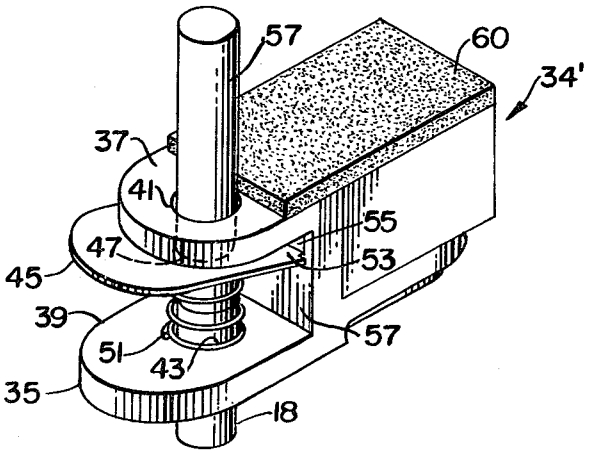
FIG. 4 is a perspective view of one embodiment of a clamping member of the present invention.

An alternative first clamping member 34' is depicted in FIG. 4 including a generally U-shaped frame member 35 having a first extending arm 37 and a second extending arm 39 each of which has an aperture 41, 43, respectively, axially aligned. Shaft 18 extends through apertures 41 and 43. Intermediate of arms 37 and 39 is tongue 45 including an aperture 47 through which shaft 18 also extends. Tongue 45 is biased towards arm 37 by means of a coiled spring 51 but may be depressed by compressing spring 51 as tongue 45 is caused to pivot about a tip 53 extending into an opening 55 in the base 57 of the U-shaped member 35. When tongue 45 is depressed, the axis of aperture 47 becomes aligned with the axis of apertures 41 and 43 allowing the member 35 to be slid along shaft 18. When tongue 45 is not depressed, the axis of aperture 47 is no longer so aligned and movement of the member 35 relative to the shaft 18 is prevented.

A second clamping member 34 is moveably interconnected to the other end 36 of shaft 18 such that the second clamping member may also be moved relative to the shaft, clamping member 34 also including means coupled therewith for operatively locking the clamping member in place upon the shaft. For example, in the preferred embodiment, the second clamping member comprises a camming surface 38 pivotally affixed to shaft 18 at its end 36. As depicted in the drawings, the camming surface 38 may comprise two side walls 40, 42 connected by a top wall 44 to form a channel 46 into which extends the end 36 of shaft 18. The side walls and shaft include apertures 48 and 50, respectively, through which extends a pivot pin 52 about which the camming surface pivots relative to the shaft.

In operation, the embodiment depicted in FIGS. 1 and 2 may be operated in the following manner. The straight edge 4 is placed upon the board in the desired position so that the first clamping member 22 is positioned beneath the board, and the second clamping member is above the board and in the position denoted by the reference "A." It will be noted that in this preliminary position, the camming surface 38 engages the bearing member 8. In the next step, the first clamping member 22 is slid along shaft 18 until it engages one surface 56 of board 6 at which position nut 32 is tightened to lock the first clamping member in place. Finally, the second clamping member is pivotted about pin 52 to the position denoted by the reference "B" such that the high point 54 of camming surface 38 pivots into engagement with the bearing member 8 thereby causing the shaft, and first clamping member locked thereto, to move towards the second clamping member. The compressive forces exerted by so pivotting the second clamping member operatively locks the second clamping member in place. It can be seen that the clamping members 22 and 24 are moveable relative to each other and to the shaft in such a manner that when the clamping members are operatively locked in place as described above, the first clamping member engages and exerts a compressive force against one surface 56 of the board 6 and the second clamping member 34 engages the bearing member 8 to thereby exert an opposing compressive force against the opposing surface 58 of board 6 to lock the straight edge in place.

In an alternative embodiment, a clamping device may be provided which may be positioned anywhere along the length of the straight edge. In this embodiment, as depicted in FIG. 3, a bearing member 102 is substituted for bearing member 8, including flange 14, sleeve 16 and nut 17, all of which are omitted. The remaining portion of the clamping device 2 is identical to that depicted in FIGS. 1 and 2 and has therefore not been shown in FIG. 3. Bearing member 102 includes an elongated channel 104 through which extends the straight edge 4. The bearing member 102 includes an aperture 106 through which extends shaft 18 in the same manner as shaft 18 extends through aperture 10 of bearing member 8. The clamping device having bearing member 102 operates in a manner similar to device 2 with the exception that after the straight edge is positioned upon the board as desired, the bearing member 102 is slid along the straight edge, as the length of the straight edge 4 passes through elongated channel 104, until the bearing member 102 is adjacent the board. It is at this point that the clamping members are operatively locked as described above.

Figure 2:
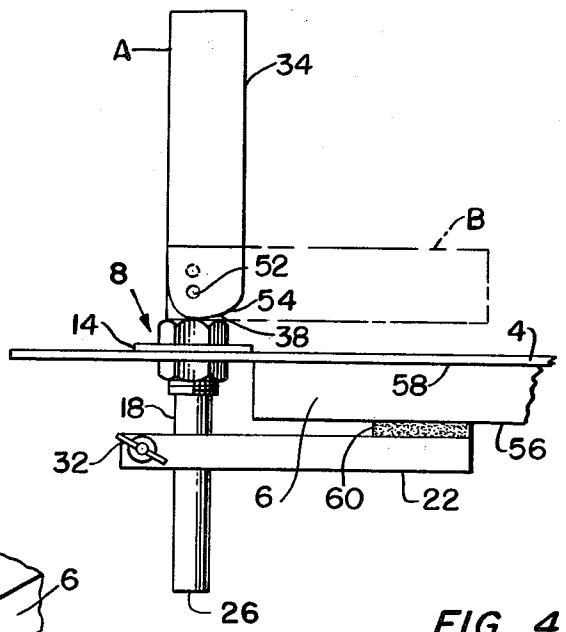
FIG. 2 is a side view of the clamping device of the present invention in the locked and unlocked positions.
Figure 3:
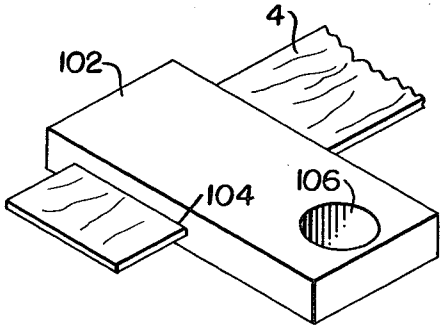
FIG. 3 is a perspective view of an alternative embodiment of the bearing member of the present invention.

In those instances where a clamping device of the type depicted in FIGS. 1 and 2 is used, such a clamping device may be positioned at one or both ends of a straight edge. In those instances where a clamping device including a bearing member of the type depicted in FIG. 3 is used, such clamping device may be used individually or in combination with a second device of the type depicted in FIGS. 1 and 2. In either case, in the preferred embodiment, the first clamping member includes a resilient pad 60 affixed thereto for engagement with the board 6.

In those instances where straight edge 4 is provided having an elongated slot 12 as depicted in the drawing, the clamping device 2 is slid along the slot to the desired position relative to the straight edge, and the clamping device 2 is locked into position in the manner described herein.

In all embodiments, it is possible to pivot the straight edge 4 about the bearing member to the desired angular position before locking the straight edge in place. For example, in the device depicted in FIG. 1, the straight edge 4 may be pivoted about cylindrical sleeve 16, which extends through aperture 12, until the straight edge is in the desired position.

The embodiments which have been described herein are but some of several which utilize this invention and are set forth here by way of illustration but not of limitation. It is apparent that many other embodiments which will be readily apparent to those skilled in the art may be made without departing materially from the spirit and scope of this invention.

What is claimed is:

1. A clamping device for clamping a straight edge to a board at any desired angle relative to the edge of said board comprising a bearing member including an aperture therethrough, means coupled with said bearing member for connecting said bearing member to said straight edge, an elongated shaft moveably extending through said aperture, a first clamping member moveably interconnected to one end of said shaft, a second clamping member moveably interconnected to the other end of said shaft, and means coupled with said clamping members for operatively locking said clamping members in place upon said shaft, said clamping members being moveable relative to each other and said shaft such that when said clamping members are so locked in place said first clamping member engages and exerts a compressive force against one surface of said board and said second clamping member engages said bearing member and thereby exerts an opposing compressive force to lock said straight edge in place.

2. The device of claim 1 for use with a straight edge having an aperture therethrough wherein said bearing member comprises a radially extending flange coupled to one end of a cylindrical sleeve, and wherein said bearing member is connected to said straight edge by insertion of said sleeve through said straight edge aperture.

3. The device of claim 2 wherein said second clamping member comprises a camming surface pivotally affixed to said one end of said shaft, said camming surface having a high point which pivots into engagement with said bearing member when said clamping members are so locked in place.

4. The device of claim 3 wherein said first clamping member includes an opening through which said other end of said shaft extends, and an aperture which extends transverse thereto, and said locking means includes a bolt which extends through said aperture and includes a nut threaded thereupon the tightening of which so locks said first clamping member in place upon said shaft.

5. The device of claim 2 wherein said sleeve is externally threaded, and said bearing member further comprises a nut which is threaded upon said sleeve to sandwich said straight edge between said flange and said nut.

6. The device of claim 1 wherein said bearing member further includes an elongated channel through which said straight edge may extend to moveably couple said bearing member to said straight edge.

7. The device of claim 3 wherein said camming surface comprises two side walls connected by a top wall to form a channel into which extends said shaft, said shaft and said side walls including apertures through which extends a pivot pin about which said camming surface pivots relative to said shaft.

8. The device of claim 1 wherein said first clamping member comprises a U-shaped frame member including a first and second arm each of which includes an aperture therethrough in axially alignment, and a tongue intermediate of said arms and having an aperture therethrough, said tongue being biased towards said first arm, and spaced from said second arm by a coiled spring, said shaft extending through the apertures of said arm, tongue and said spring, whereby when said tongue is depressed said tongue aperture is in alignment with said arm apertures and said U-shaped member may be moved upon said shaft.

9. The device of claim 2 wherein said straight edge aperture comprises an elongated slot.

* * * * *